US008548124B2

(12) United States Patent
Hauttmann et al.

(10) Patent No.: US 8,548,124 B2
(45) Date of Patent: Oct. 1, 2013

(54) ELECTRON SOURCE AND CATHODE CUP THEREOF

(75) Inventors: Stefan Hauttmann, Buchholz (DE); Zoryana Terletska, Hamburg (DE)

(73) Assignee: Koninklijke Philips N.V., Eindhoven (NL)

( * ) Notice: Subject to any disclaimer, the term of this patent is extended or adjusted under 35 U.S.C. 154(b) by 162 days.

(21) Appl. No.: 13/131,906

(22) PCT Filed: Dec. 1, 2009

(86) PCT No.: PCT/IB2009/055432

§ 371 (c)(1), (2), (4) Date: May 31, 2011

(87) PCT Pub. No.: WO2010/067257

PCT Pub. Date: Jun. 17, 2010

(65) Prior Publication Data

US 2011/0228909 A1 Sep. 22, 2011

(30) Foreign Application Priority Data

Dec. 8, 2008 (EP) ..... 08170904

(51) Int. Cl.
*H01J 35/06* (2006.01)

(52) U.S. Cl.
USPC ..... 378/136; 378/143

(58) Field of Classification Search
USPC ..... 378/136, 134, 143, 119
See application file for complete search history.

(56) References Cited

U.S. PATENT DOCUMENTS

| | | | |
|---|---|---|---|
| 2,471,298 | A | 5/1949 | Atlee et al. |
| 5,044,005 | A | 8/1991 | De Fraguier et al. |
| 5,907,595 | A | 5/1999 | Sommerer |
| 6,426,587 | B1 | 7/2002 | Hell et al. |

FOREIGN PATENT DOCUMENTS

| | | | |
|---|---|---|---|
| DE | 581946 | C | 9/1933 |
| GB | 496651 | A | 11/1938 |
| GB | 960458 | | 6/1964 |
| JP | 60063863 | | 4/1985 |
| WO | 2007132380 | A2 | 11/2007 |

*Primary Examiner* — Irakli Kiknadze

(57) ABSTRACT

An embodiment of the invention relates to a cathode cup (20) comprising a receptacle for holding an electron emitter (21), wherein the cathode cup is provided at least in the area facing the electron emitter (21) with a surface comprising a plurality of cavities (23). Further, the invention provides an electron source and an x-ray system comprising such a cathode cup (20).

20 Claims, 5 Drawing Sheets

ELECTRON SOURCE AND CATHODE CUP THEREOF

FIELD OF THE INVENTION

The invention relates to a cathode cup as well as an electron source and an X-ray system having such a cathode cup.

BACKGROUND OF THE INVENTION

Electron sources are employed for different applications such as X-ray systems like tomography (CT) and cardiovascular (CV) systems. These electron sources usually comprise thermionic emitters which emit electrons upon reaching a certain temperature. The filaments forming these thermionic emitters are necessarily made of metal with a high melting point, like tungsten, lanthanum or their alloys. These thermionic emitters are usually fixed to a cathode cup which primarily acts as an electron-optical focusing element.

SUMMARY OF THE INVENTION

It is an object of the present invention to provide an improved cathode cup, an electron source and an X-ray system.

This object is solved with a cathode cup, according to the independent claim.

FIG. 1 shows an electron source. This electron source comprises a cathode cup 10 with a recess in which an electron emitter 11 is fixedly held. The electron emitter 11 is formed as a flat plate with a serpentine like emission area 12. Upon applying a voltage to the electron emitter 11, the emission area 12 emits electrons. During the exposure time, the emission area 12 reaches temperatures above 2000° C., in order to emit these electrons. The high temperature has the effect that material of the electron emitter 11 evaporates and is deposited on cold surfaces around the electron emitter 11.

FIG. 2 shows the electron source of FIG. 1 with deposited material. The material which is evaporated due to the hot temperatures of the emission area 12 creates a thin film 13 on the cathode cup surface directly face to face with the emission area 12.

FIG. 3 shows the separation of deposited material. Due to different applications, the temperature of the cathode cup 10 changes. In case of using different materials for the cathode cup 10 and the electron emitter 11, thermo-mechanical stress due to different thermal expansion coefficients is caused. The resulting shearing force could exceed the adhesion force which leads to a separation 14 of the thin film 13 from the surface of the cathode cup 10. This separation usually starts at the borders of the thin film 13. Depending on the temperature and density distribution within the thin film 13, there is the risk that the thin film 13 bends towards the electron emitter 11 and gets in contact with it. Such a contact would change the electrical path of the current and would thus lead to drastically changed thermal and electrical properties of the electron emitter 11, which would lead to a malfunction of the electron source.

The inventors of the present invention recognized that it is advantageous to avoid such a separation by changing the adhesion behavior of the thin film with respect to the cathode cup 10.

According to an embodiment of the present invention, there is provided a cathode cup comprising a receptacle for holding an electron emitter, wherein the cathode cup is provided at least in the area facing the electron emitter with a surface comprising a plurality of cavities. The main reason for the spalling effect caused by different thermal expansion coefficients is the concentration of shearing forces at the end of the thin film and its adhesion on the cathode cup surface being too low. The appearance of spalling of the thin film with its possible negative influence on the electron source properties can be overcome with the mentioned embodiment, because in this embodiment the adhesion behavior of the surface facing the electron emitter is increased.

According to a further embodiment, the cavities are formed in the material of the cathode cup. This provides the advantage that the cavities can be easily formed without too much effort.

According to another embodiment, the cavities are formed in a coating covering the cathode cup at least partially. In this embodiment it is possible that the cathode cup surface is covered with the coating and the cavities are formed in the coating afterwards or to cover the cathode cup surface with a coating that already comprises cavities in the form of a structure or a texture of the coating.

According to a further embodiment, the cavities are created by laser drilling. This manufacturing has the advantage that no sharp edges are generated which would act as stress concentrators, where cracks could be initialized.

Alternatively, the cavities are created by milling.

As an alternative thereto, the cavities are created by sink eroding.

According to another embodiment, the cavities are formed as depressions, the perimeters of which contact each other. This provides the advantage that the area is utilized optimally for providing the cavities.

According to a further embodiment, the receptacle comprises a recess within which the electron emitter is arranged and sockets for fixing the electron emitter. By providing the electron emitter within a recess, the cathode cup can act as an electron-optical focusing element.

According to a further embodiment, the cavities are provided between the sockets. This area is the part of the cathode cup which is closest to the part where electrons are emitted and therefore it is advantageous that the cavities are provided in this area.

Further, the invention provides an electron source and an X-ray system comprising a cathode cup, according to one of the above described embodiments. These devices offer the same advantages as mentioned above. The cathode cup is beneficially applicable to any field in which thermionic emitters with high emission currents are necessary.

These and other aspects of the invention will be apparent from and elucidated with reference to the embodiments described hereafter.

It may be seen as the gist of the invention to provide a cathode cup holding an electron emitter with a surface having improved adhesion properties at least in an area facing the electron emitter, in order to avoid the separation of deposited evaporated material.

DETAILED DESCRIPTION OF EMBODIMENTS

Figure 4:
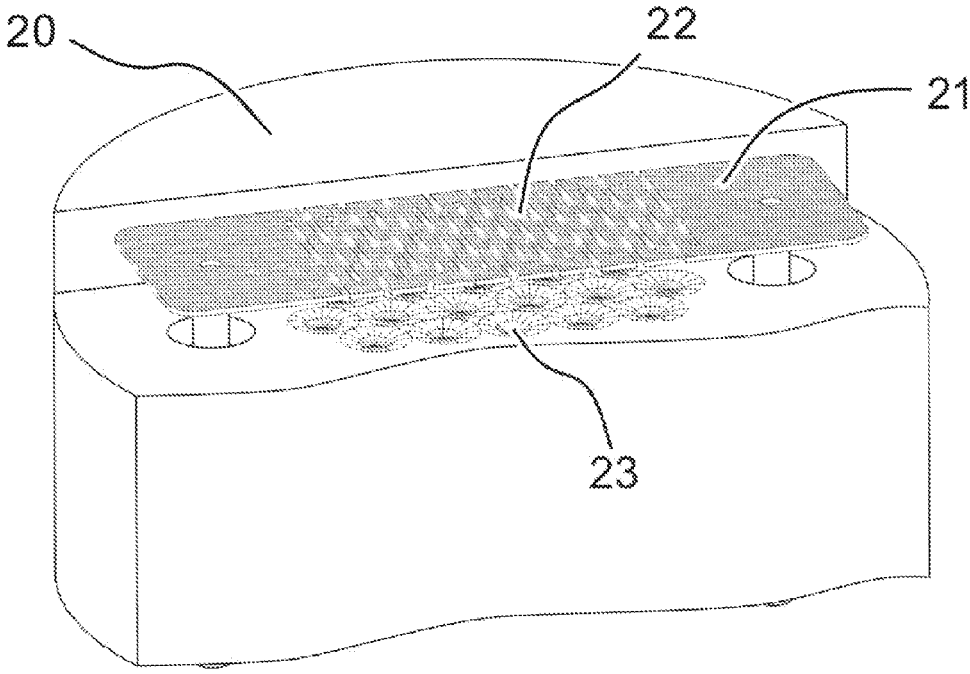
FIG. 4 shows an electron source according to a first embodiment of the invention.

FIG. 4 shows an electron source according to a first embodiment of the invention. The illustrated electron source comprises a cathode cup 20 having a cylindrical form wherein on a face side (upper side in FIG. 4) the cathode cup 20 is provided with a recess having a rectangular cross-sectional area and leading along the diameter of the cylindrical form. The bottom face of the recess is provided with two sockets for holding an electron emitter 21. The electron emitter 21 is a substantially rectangular flat plate, the center area of which is forming an emitting area 22 which is formed serpentine-like by bringing in cuts having the length of approximately 80 to 90 percent of the width of the electron emitter 21 and which are alternately opened to one side or the other side of the electron emitter 21. Upon applying a voltage to the electron emitter 21, the emission area 22 emits electrons. For this purpose, the serpentine-like form decreases the cross-sectional area along the streaming path of the current such that the resistance of the electron emitter is increased in the emitting area 22. The electron emitter 21 is provided on a side facing the cathode cup 20 with pins which fit into the sockets of the cathode cup 20. The electron emitter 21 can be fixedly held by the cathode cup 20 by fitting the pins into the sockets. The electron emitter 21 is made of metal with a high melting point, such as tungsten, lanthanum or their alloys. The surface of the cathode cup 20 facing the emitting area 22 is provided with cavities 23 which can be realized by laser drilling, milling or sink welding. The cavities 15 are formed between the two sockets in the form of depressions, the perimeter of which contacts each other. Even if this is the preferred form, the cavities 23 can have a plurality of possible forms, for example through holes along a vertical direction in the Figures, counterbores, bole-formed holes, conical holes narrowing to the bottom, cylindrical holes, dents, drillings, grooves, cracks, etc.

Figure 1:
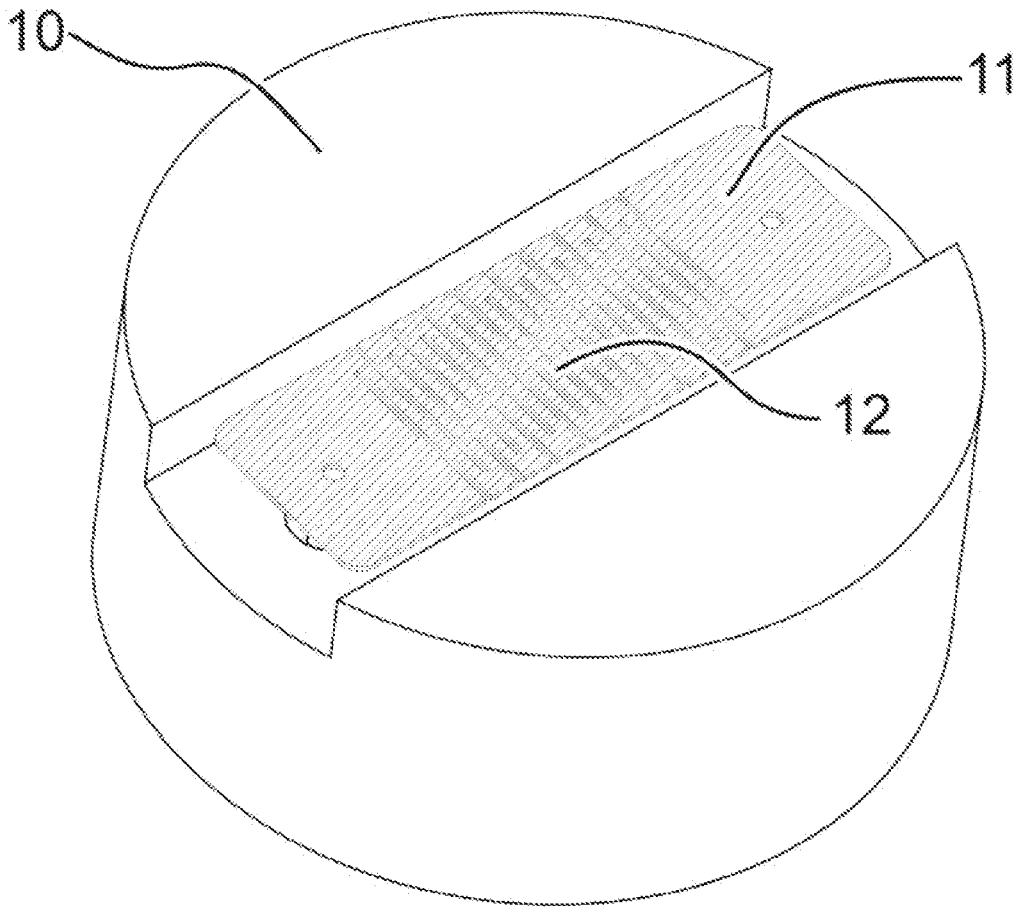
FIG. 1 shows an electron source.
Figure 2:
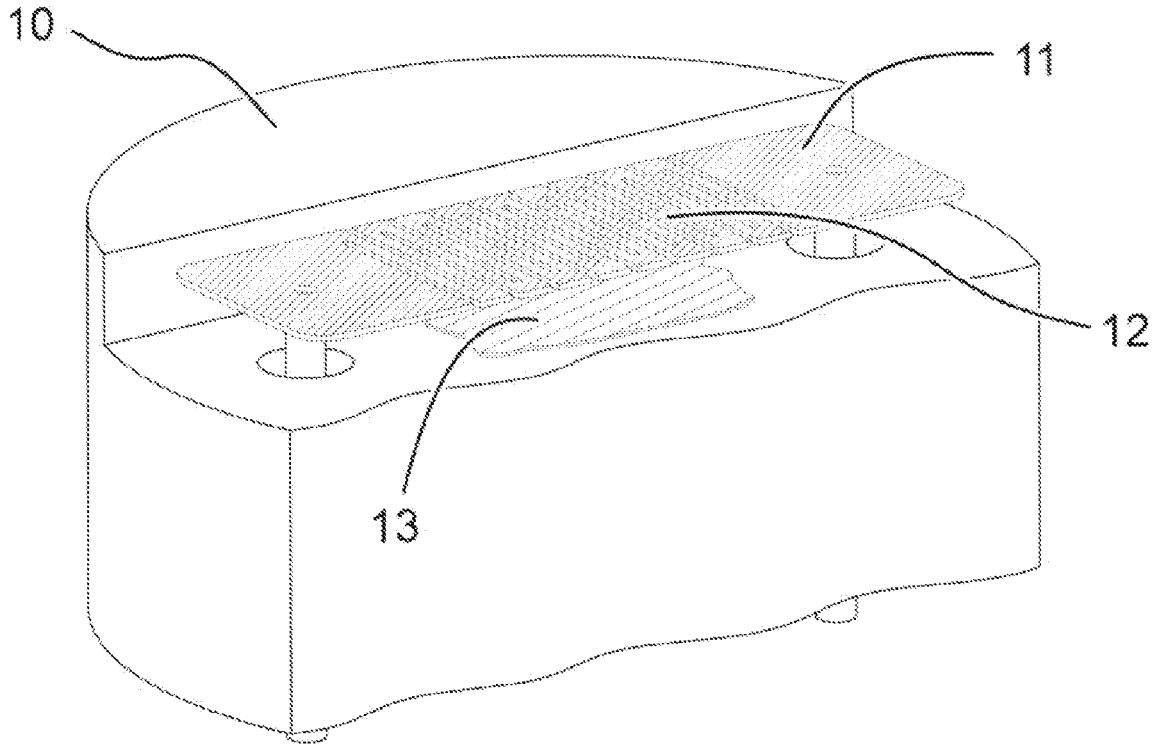
FIG. 2 shows the electron source of FIG. 1 with deposited material.
Figure 3:
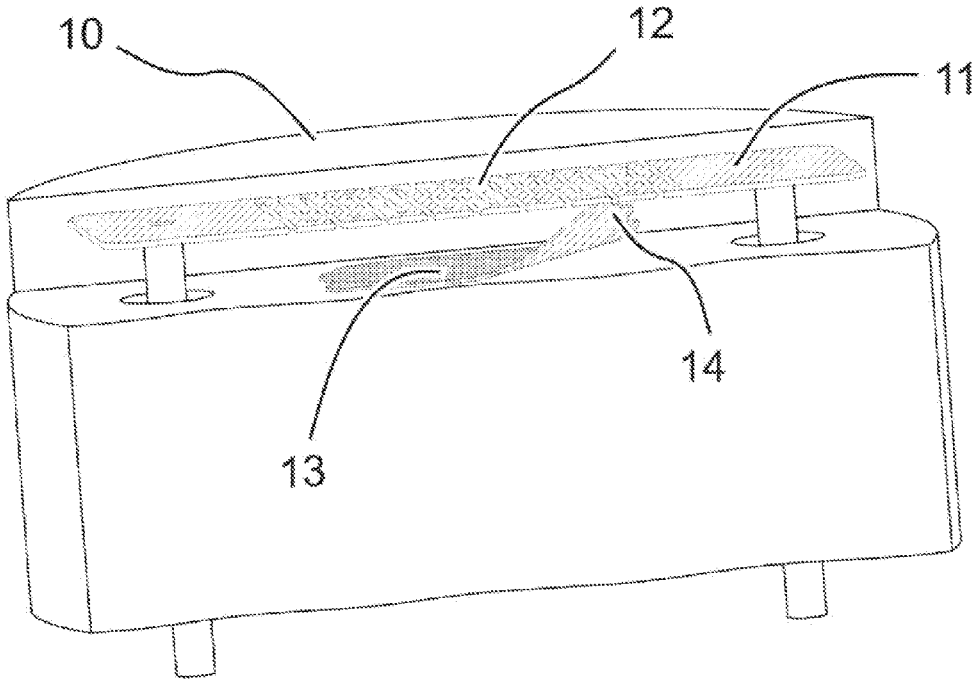
FIG. 3 shows the separation of deposited material.

Upon application of voltage to the electron emitter 21, the emitting area 22 is heated due to the increased resistance by the current up to temperatures above 2000° C. When this temperature is reached, electrons are emitted and emitter material is evaporated. A thin film deposits on the cathode cup surface that faces the emitting area 22, as described in connection with FIG. 2. During this operation, the cathode cup 20 reaches temperatures of a few hundred degrees Celsius. When the electron emitter 21 is switched off, the cathode cup 20 cools down and shear-stress within the interface between the thin film of deposited material and the cathode cup 20 results. The stress maximum is located at the borders of the thin film. According to this embodiment, a separation of the thin film from the surface of the cathode cup 20 can be avoided by reducing the maximum shear-stress within the interface between the thin film and the surface of the cathode cup 20. Such a reduction of the maximum shear-stress can be achieved by splitting the pure shear-stress in case of a flat surface into a lateral (shearing) and a perpendicular (tensile or comprehensive) component. This is realized in this embodiment by structuring the deposition surface with cavities 23, i.e. it is realized by changing the topology of the cathode surface facing the emitter by structuring the surface with cavities having the form as described above. The size of the cavities 23 is optimized according to the estimated thickness of the deposited film in such a way that even in case of a film fracture, fragments of the thin film will remain within the cavities 23.

Figure 5:
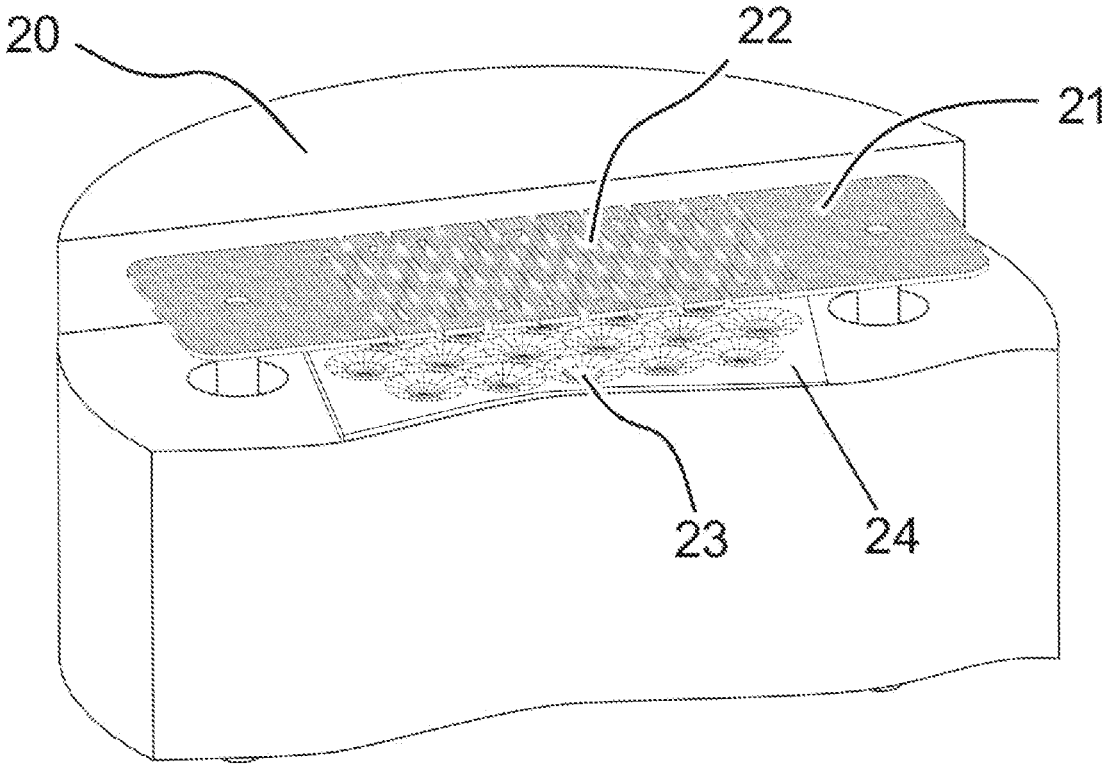
FIG. 5 shows an electron source according to a second embodiment of the invention.

FIG. 5 shows an electron source according to a second embodiment of the invention. In order to avoid repetitions, only the aspects are described for this embodiment, which differ from the first embodiment. This embodiment differentiates from the first embodiment in that the cavities 23 are not directly formed in the material of the cathode cup 20. Instead, the surface of the cathode cup 20 between the two sockets being the area face to face to the emitting area 22 is covered with a coating 24. Either this coating 24 already comprises a texture or a structure before it is applied to the cathode cup 20 which comprises cavities, or the coating 24 is applied to the cathode cup 20 and thereafter the cavities 23 are formed into the coating 24 by means of the processing mentioned in connection with the first embodiment.

While the invention has been illustrated and described in detail in the drawings and foregoing description, such illustration and description are to be considered illustrative or exemplary and not restrictive and it is not intended to limit the invention to the disclosed embodiments. The word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used advantageously. Any reference signs in the claims should not be construed as limiting the scope of the invention.

The invention claimed is:

1. A cathode cup comprising:

a receptacle for holding an electron emitter, the electron emitter having an emission area from which (i) electrons are emitted and (ii) emitter material is evaporated; and a surface within the receptacle that comprises a plurality of cavities, wherein the plurality of cavities (a) re provided at least in a deposition surface area of the surface facing the emission area of the electron emitter and (b) configured to reduce a maximum shear-stress within an interface between (i) a film of evaporated emitter material deposited in the deposition surface area and (ii) the surface.

2. The cathode cup according to claim 1, further wherein the plurality of cavities are formed in the material of the cathode cup.

3. The cathode cup according to claim 1, further wherein the plurality of cavities are created by laser drilling.

4. The cathode cup according to claim 1, wherein the plurality of cavities are created by milling.

5. The cathode cup according to claim 1, further wherein the plurality of cavities are created by sink eroding.

6. The cathode cup according to claim 1, further wherein the plurality of cavities are formed as depressions having perimeters which contact each other.

7. The cathode cup according to claim 1, wherein the receptacle comprises a recess within which the electron emitter is arranged and sockets for fixing the electron emitter.

8. An electron source comprising:

the cathode cup according to claim 1; and an electron.

9. The electron source according to claim 8, wherein an area of the electron emitter having an increased resistance is facing the plurality of cavities.

10. An x-ray system comprising:

the cathode cup according to claim 1; and an electron emitter.

11. The cathode cup according to claim 1, wherein further the plurality of cavities are formed in a coating covering the cathode cup at least partially.

12. The cathode cup according to claim 11, wherein the plurality of cavities are further formed as depressions having perimeters which contact each other.

13. The cathode cup according to claim 11, wherein the receptacle comprises a recess within which the electron emitter is arranged and sockets for fixing the electron emitter.

14. The cathode cup according to claim 13, wherein further the plurality of cavities are provided between the sockets.

15. The cathode cup according to claim 1, wherein the plurality of cavities are provided between sockets.

16. A cathode cup comprising:

a receptacle for holding an electron emitter, wherein the cathode cup is provided at least in the area facing the electron emitter with a surface comprising a plurality of cavities, wherein the plurality of cavities are formed in a coating covering the cathode cup at least partially.

17. The cathode cup according to claim 16, wherein the plurality of cavities are further formed as depressions having perimeters which contact each other.

18. The cathode cup according to claim 16, wherein the receptacle comprises a recess within which the electron emitter is arranged and sockets for fixing the electron emitter.

19. The cathode cup according to claim 18, wherein the plurality of cavities are provided between the sockets.

20. A cathode cup comprising:

a receptacle for holding an electron emitter, wherein the cathode cup is provided at least in the area facing the electron emitter with a surface comprising a plurality of cavities, wherein the plurality of cavities are provided between sockets.

* * * * *